US011472654B2

(12) United States Patent
Perego

(10) Patent No.: US 11,472,654 B2
(45) Date of Patent: Oct. 18, 2022

(54) FEEDING UNIT FOR A TISSUE CONVERTING MACHINE FOR CONVERTING A WEB OF TWO-LAYER TISSUE

(71) Applicant: OMET S.r.l, Lecco (IT)

(72) Inventor: Roberto Perego, Moggio (IT)

(73) Assignee: OMET S.R.L.

( * ) Notice: Subject to any disclaimer, the term of this patent is extended or adjusted under 35 U.S.C. 154(b) by 790 days.

(21) Appl. No.: 16/319,048

(22) PCT Filed: Jul. 25, 2017

(86) PCT No.: PCT/IB2017/054494
§ 371 (c)(1),
(2) Date: Jan. 18, 2019

(87) PCT Pub. No.: WO2018/020410
PCT Pub. Date: Feb. 1, 2018

(65) Prior Publication Data

US 2021/0371226 A1 Dec. 2, 2021

(30) Foreign Application Priority Data

Jul. 26, 2016 (IT) ..... IT102016000078303

(51) Int. Cl.
*B65H 35/08* (2006.01)
*B65H 19/18* (2006.01)
*B65H 19/26* (2006.01)

(52) U.S. Cl.
CPC ..... *B65H 19/1852* (2013.01); *B65H 19/265* (2013.01); *B65H 35/08* (2013.01);
(Continued)

(58) Field of Classification Search
CPC ..... B65H 19/14; B65H 19/18; B65H 19/265; B65H 19/1805; B65H 19/1852;
(Continued)

(56) References Cited

U.S. PATENT DOCUMENTS 5,190,234 A * 3/1993 Ezekiel ..... B65H 19/14 156/157
2004/0084561 A1* 5/2004 Clifford ..... B65H 23/032 242/552

(Continued)

FOREIGN PATENT DOCUMENTS

JP 2011 093642 5/2011
WO 02/40262 5/2005

(Continued)

OTHER PUBLICATIONS

International Search Report and Written Opinion of the International Searching Authority, European Patent Office, dated Nov. 7, 2017.

*Primary Examiner* — Sang K Kim
(74) *Attorney, Agent, or Firm* — Valauskas Corder LLC

(57) ABSTRACT

The feeding unit (10) comprises: support means (12) for rotatably supporting a first reel (R1) of two-layer tissue web and a second reel (R2) of two-layer tissue web about respective axes of rotation (x1, x2); cutting means (32, 42) for cutting the two layers (L1_1, L2_1) of the tissue web (W1) of the reel (R1) in use, the cutting means (32, 42) being configured to cut the two layers (L1_1, L2_1) of the tissue web (W1) along two cut lines spaced apart from each other in the longitudinal direction of the web (W1); joining means (44_1, 44_2) for joining each of the two layers (L1_2, L2_2) of the tissue web (W2) of the other reel (R2) of said first and second reels (R1, R2), and precisely of the new reel, to a respective layer (L1_1, L2_1) of the tissue web (W1) of the reel (R1) in use; and tissue web accumulation means (30) for
(Continued)

accumulating a given amount of web (W1) downstream of the cutting means (32, 42) and the joining means (44_1, 44_2) so as to ensure the feeding of the machine with the tissue web (W1) while the portion of tissue web (W1) on which the cutting means (32, 42) and the joining means (44_1, 44_2) act is kept temporarily still to allow the cutting of the two layers (L1_1, L2_1) of the tissue web (W1) in use and the joining of the latter with the two layers (L2_2, L2_2) of the new tissue web (W2).

6 Claims, 6 Drawing Sheets

(52) U.S. Cl.
CPC ..... *B65H 2301/46017* (2013.01); *B65H 2701/1864* (2013.01); *B65H 2701/1924* (2013.01)

(58) Field of Classification Search
CPC ..... B65H 35/08; B65H 2301/46017; B65H 2701/1864
See application file for complete search history.

(56) References Cited

U.S. PATENT DOCUMENTS

| | | | | |
|---|---|---|---|---|
| 2005/0241774 | A1* | 11/2005 | Hart | B65H 19/1852 156/502 |
| 2012/0267467 | A1* | 10/2012 | Okabe | B65H 19/1852 242/417 |
| 2016/0152369 | A1* | 6/2016 | Pedercini | B65C 9/0006 156/355 |
| 2016/0244290 | A1* | 8/2016 | De Marco | B65H 19/18 |
| 2017/0088380 | A1* | 3/2017 | Mark | B65H 19/1852 |
| 2017/0275116 | A1* | 9/2017 | Gnan | B65H 19/1852 |
| 2017/0291784 | A1* | 10/2017 | Adami | B65H 19/20 |
| 2017/0297849 | A1* | 10/2017 | Gnan | B65H 19/14 |

FOREIGN PATENT DOCUMENTS

| | | |
|---|---|---|
| WO | 2005/110903 | 11/2005 |
| WO | 2015/071839 | 5/2015 |

* cited by examiner

FEEDING UNIT FOR A TISSUE CONVERTING MACHINE FOR CONVERTING A WEB OF TWO-LAYER TISSUE

The present invention generally relates to the field of tissue converting machines for converting a tissue web, such as a paper web or a nonwoven fabric web, which machines are used for example in the production of napkins. More specifically, the present invention relates to a feeding unit for continuously feeding a two-layer tissue web to a machine of the type identified above.

Feeding units are known for feeding tissue converting machines, which are configured to accommodate a pair of tissue reels (one in use and the other in reserve) and to automatically join the tissue web of the reserve reel to the tissue web of the reel in use when the latter is almost spent, so as to guarantee the continuous feed of the machine with no need to stop the machine to replace the spent tissue reel with a new one. The known feeding units are, however, only able to operate on single-layer tissue webs. An example of feeding unit of this type is disclosed in WO 2005/110903.

WO 2015/071839 discloses a feeding unit for a tissue converting machine arranged to operate with a web of multi-layer tissue. According to this known solution, the tissue layers unwound from a reel are separated from each other by suitable separators upstream of a cutting and joining station where each new tissue layer is joined to a respective tissue layer of the tissue reel to be replaced. Since the tissue layers are separated from each other as they move through the feeding unit, this known solution does not ensure a precise alignment of the tissue layers with each other.

It is therefore an object of the present invention to provide a feeding unit for continuously feeding a tissue converting machine which is able to operate on a two-layer tissue web, joining the first layer of the new tissue reel to the first layer of the tissue reel to be replaced and the second layer of the new tissue reel with the second layer of the tissue reel to be replaced, and ensures that the two layers of the tissue web are kept precisely aligned with each other.

This and other objects are fully achieved according to the present invention by a feeding unit having the features set forth in independent claim 1.

Advantageous embodiments of the invention are the subject-matter of the dependent claims, the content of which is to be understood as forming an integral and integrating part of the following description.

In summary, the invention is based on the idea of providing a feeding unit comprising:

support means for rotatably supporting a first reel of two-layer tissue web and a second reel of two-layer tissue web about respective axes of rotation;

cutting means for cutting the two layers of the tissue web of one of said first and second reels, namely the reel that is being used, said cutting means being configured to cut the two layers of the tissue web along two cut lines spaced from each other in the longitudinal direction of the web;

joining means for joining each of the two layers of the tissue web of the other of said first and second reels, namely the new reel, to a respective layer of the tissue web of the reel in use; and tissue web accumulation means for accumulating a given amount of tissue web downstream of the cutting means and the joining means so as to ensure that the machine is fed with the tissue web while the portion of tissue web on which the cutting means and the joining means act is kept temporarily still to allow cutting of the two layers of the tissue web in use and joining of these layers with the two layers of the new tissue web, wherein said cutting means comprise a first cutting member for cutting the inner layer of the tissue web in use and a pair of second cutting members which are placed on opposite sides of the first cutting member with respect to a plane parallel to the tissue web in use and are arranged to cut the outer layer of the tissue web in use, said second cutting members being positioned at a distance from said first cutting member in the longitudinal direction of the tissue web in use, wherein said first cutting member is placed downstream of said second cutting members with respect to the feeding direction of the tissue web in use, and wherein each of said second cutting members comprises a separating element adapted to be inserted between the two layers of the tissue web in use to keep said layers detached from each other along a side edge of the tissue web in use.

A feeding unit thus configured is therefore able to continuously feed the machine with a two-layer tissue web, joining each of the two layers of the new tissue web to the respective layer of the tissue web in use when the latter is almost spent, with no need to stop operation of the machine. Moreover, since the two layers of the tissue web in use are always kept attached to each other, except when the tissue web in use is cut by the cutting means (as they are detached from each other by means of the separating element of the second cutting member), it is ensured that the two layers of the tissue web are always precisely aligned to each other.

Further characteristics and advantages of the present invention will become more apparent from the following detailed description, given purely by way of non-limiting example with reference to the accompanying drawings, where:

Figure 1:
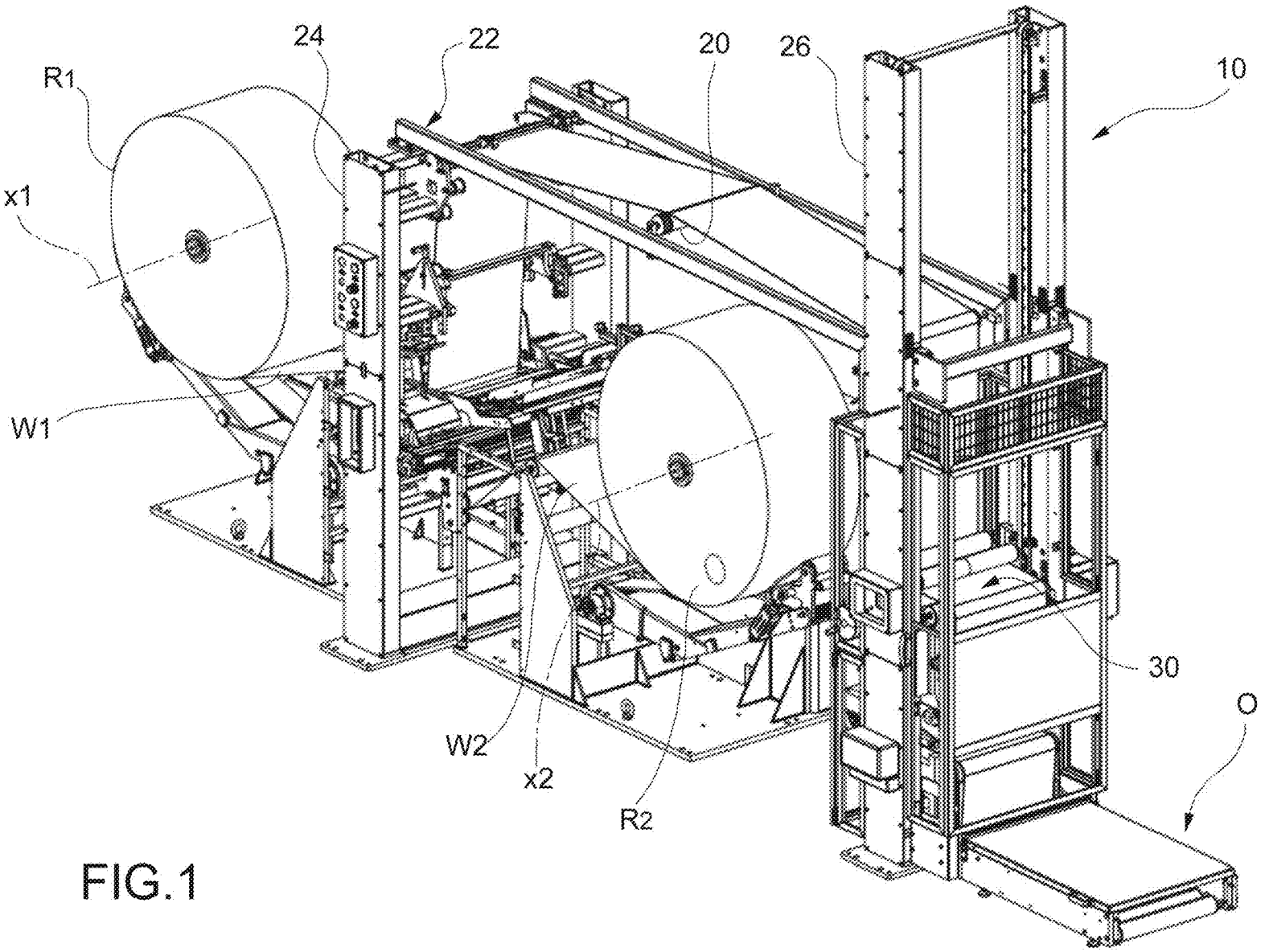
FIG. 1 is a perspective view of a feeding unit according to an embodiment of the present invention.
Figure 2:
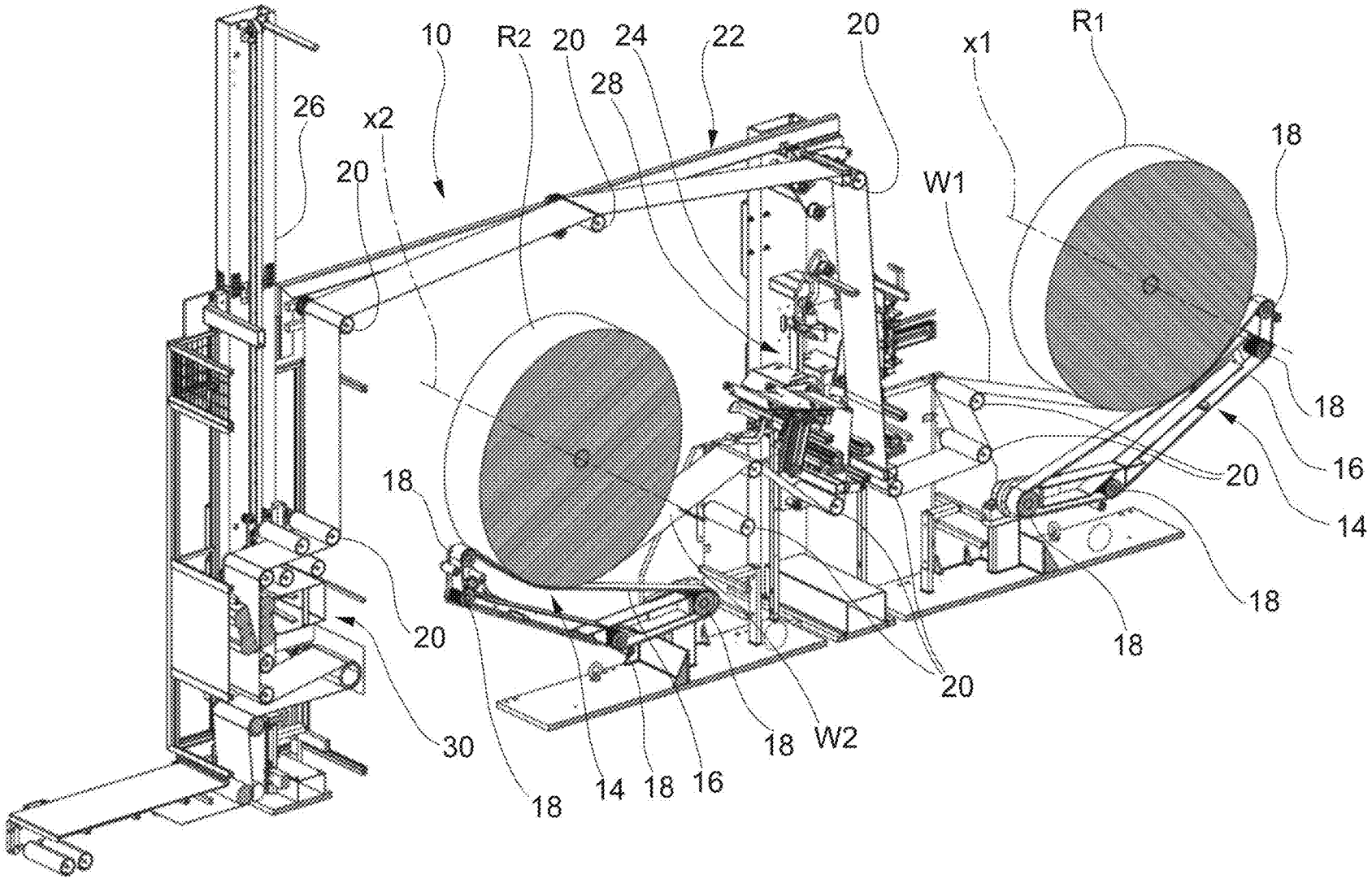
FIG. 2 is a further perspective view of the feeding unit of FIG. 1, where the feeding unit is sectioned through a vertical cross-section plane perpendicular to the axes of rotation of the reels.
Figure 3:
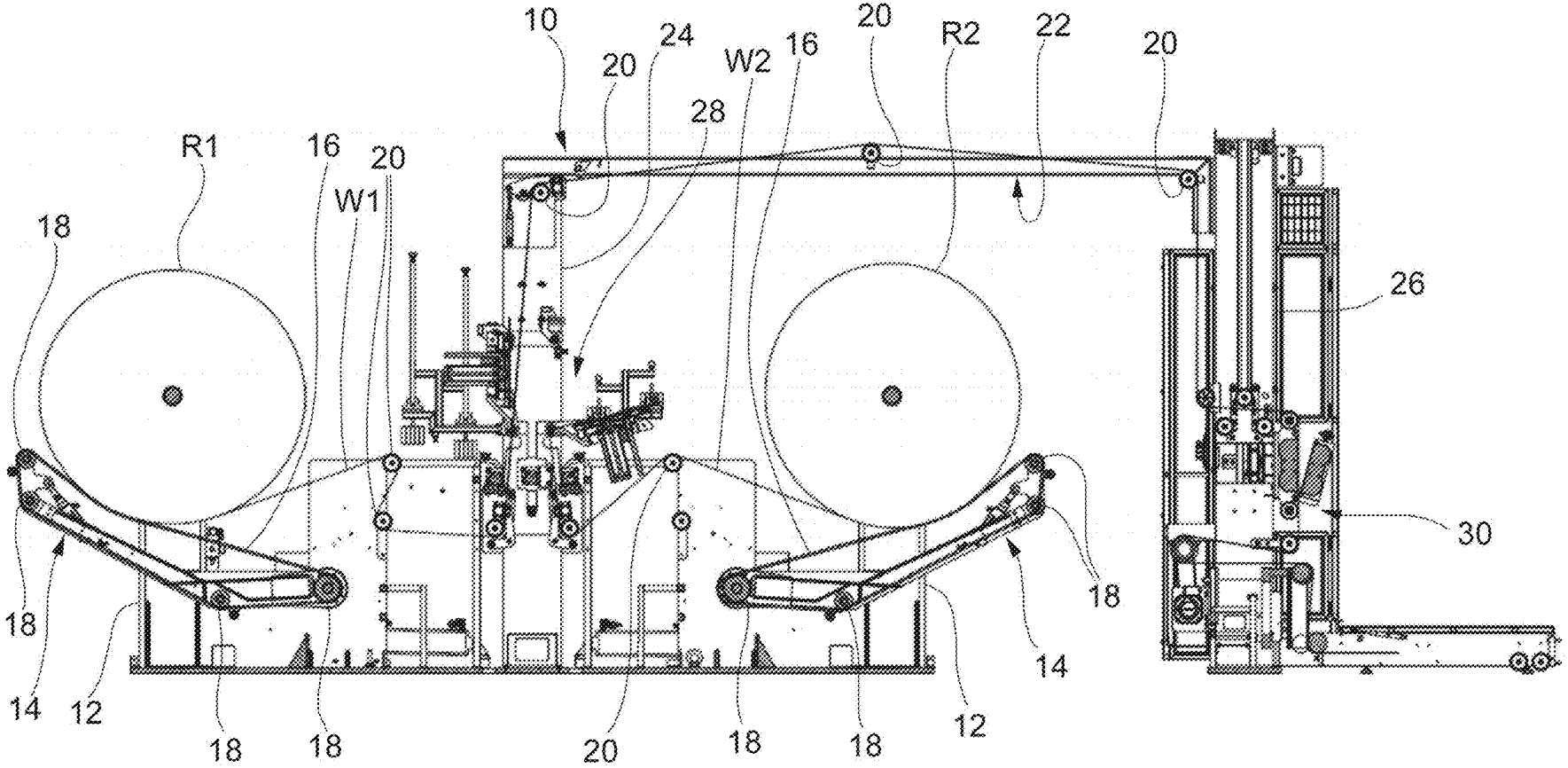
FIGS. 3 and 4 are a front view and a rear view of the feeding unit of FIG. 1, respectively.
Figure 4:
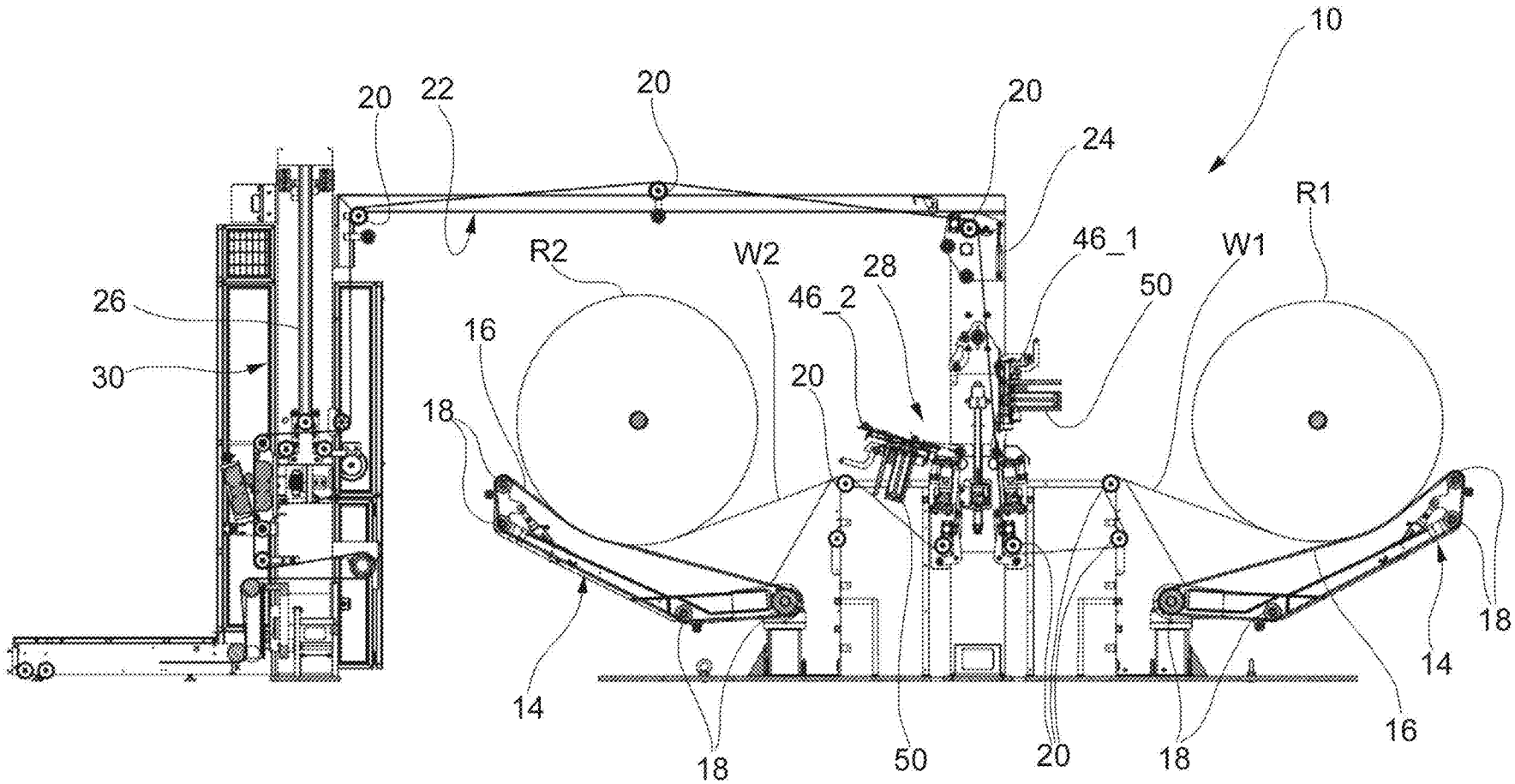

Referring first to FIGS. 1 to 4, a feeding unit for feeding a tissue converting machine for converting a two-layer tissue web (such as a two-layer paper web) is generally indicated at 10.

Although reference is made in the following description to a two-layer tissue, the feeding unit of the invention is also capable of operating on tissue webs having more than two layers. The following description is thus also applicable to the case of a tissue web having more than two layers, since each of the two layers mentioned below may be in turn formed of two or more layers. The invention is not therefore to be intended as limited to the use of a two-layer tissue web, but also includes the case where the tissue web with which the machine is fed by the feeding unit of the invention is a tissue web having more than two layers.

The feeding unit 10 is arranged to unroll the two-layer tissue web (hereinafter simply referred to as web) from a reel and to eject it from an output O, facing the machine (which is of a known type and is therefore not shown in the drawings), with a given linear speed, for example equal to 600 m/min. The feeding unit 10 is further arranged to feed the machine continuously, i.e. without having to stop the machine when it is necessary to replace the spent reel with a new reel. To this end, as will be explained in more detail in the remaining part of the description, the feeding unit 10 contains a pair of reels, indicated at R1 and R2, respectively, one of which is in use while the other serves to replace the first one when the latter is almost spent. In the example shown in the drawings, the reel in use is the reel R1, which is facing the side opposite to the output O, while the reel R2, placed on the same side as the output O, is intended to replace the reel R1 when the latter is almost spent. According to the invention, the transition from one reel to the other is achieved by joining the web (indicated at W2) of the new reel R2 to the web (indicated at W1) of the reel R1 in use, after cutting the latter, in particular by joining a first layer L1_2 of the new web W2 to a first layer L1_1 of the web W1 in use and joining the other layer L2_2 of the new web W2 to the other layer L2_1 of the web W1 in use.

The feeding unit 10 comprises first of all a pair of support uprights 12 for supporting each a respective reel R1, R2 in a freely rotatable manner about its axis. The axes of the two reels R1 and R2, indicated at x1 and x2, respectively, are oriented horizontally and parallel to each other. In addition, the axes x1 and x2 are oriented perpendicularly to the direction along which the web W1 in use leaves the feeding unit 10 through the output O. Each reel R1, R2 is associated with an actuation device 14 arranged to drive the reel for rotation about its axis x1, x2 to cause the web W1, W2 to unroll from that reel. In the proposed embodiment, each actuation device 14 controls the rotation of the respective reel R1, R2 by means of an endless belt 16 which is wound around a set of pulleys 18 (one of which acts as a driving pulley) and is held in contact against the side surface of the reel R1, R2 with a given force of contact.

The web W1 unrolled from the reel R1 is conveyed to the output O of the feeding unit along a given path defined by a plurality of rollers 20 oriented with the respective axes of rotation parallel to the axes of rotation x1 and x2 of the two reels R1 and R2. The rollers 20 are supported by a support frame 22, which has, for example, a portal-like structure comprising a first upright 24 and a second upright 26. The first and second reels R1 and R2 are arranged on opposite sides of the first upright 24, with the second reel R2 interposed between the first upright 24 and the second upright 26.

On the first upright 24 there is provided a cutting and joining unit, generally indicated at 28, which is arranged to cut the two layers L1_1 and L2_1 of the web W1 in use and to join each of the two layers L1_2 and L2_2 of the new web W2 to a respective layer of the first web W1. On the second upright 26 there is provided a web accumulation unit, generally indicated at 30, which is arranged to accumulate, before the cutting and joining unit 28 performs the operations of cutting the web W1 in use and joining the new web W2 with the first web W1, a given quantity of web downstream of the cutting and joining unit 28 to ensure that the machine continues to be fed with the web W1 while the portion of web W1 on which the cutting and joining unit 28 acts is held temporarily stationary to allow the cutting and joining operations to be carried out. The accumulation unit 30 is of per-se-known type and will therefore not be described in further detail.

Figure 5:
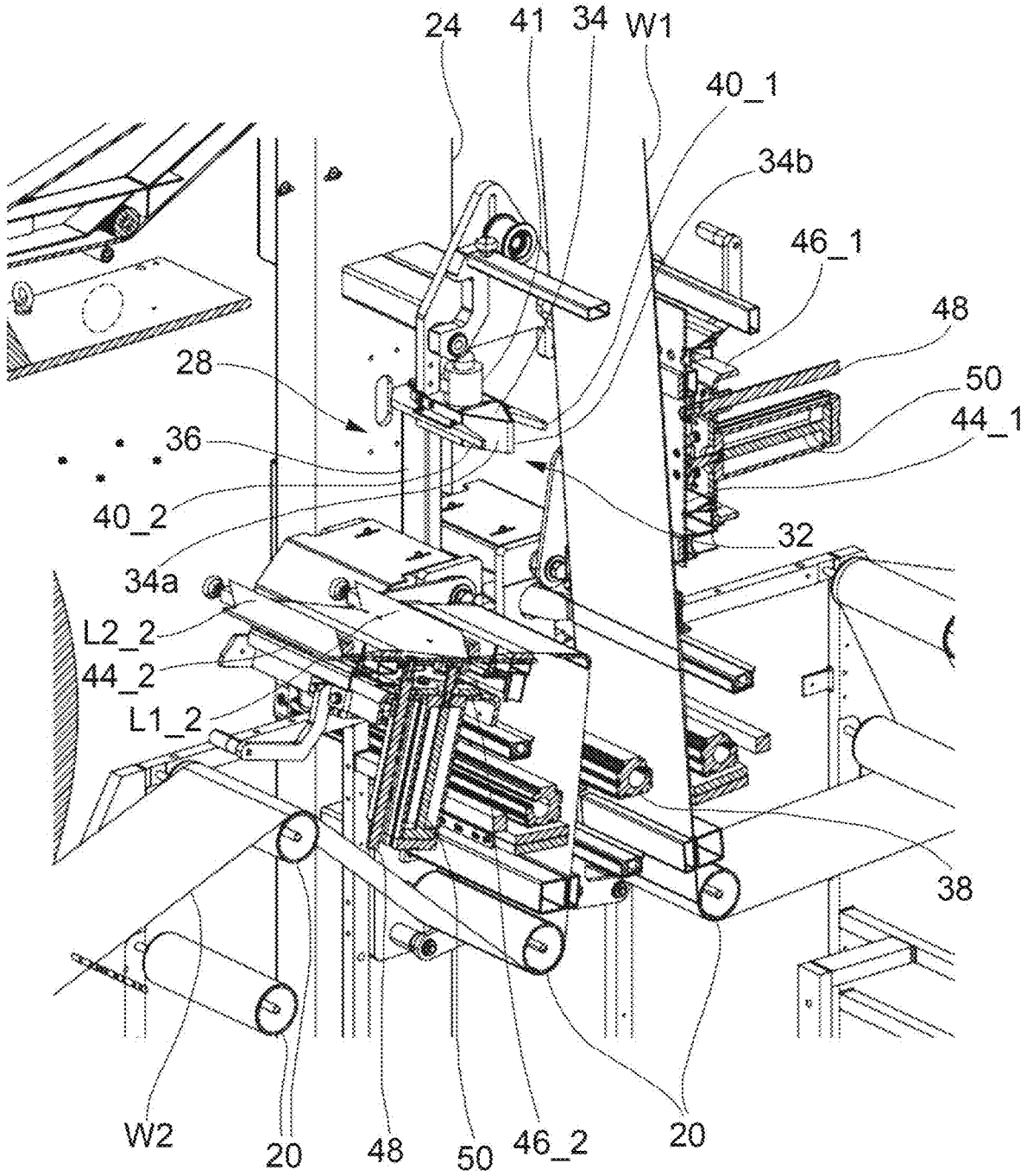
FIG. 5 shows, on enlarged scale, the detail A of FIG. 2.
Figure 6:
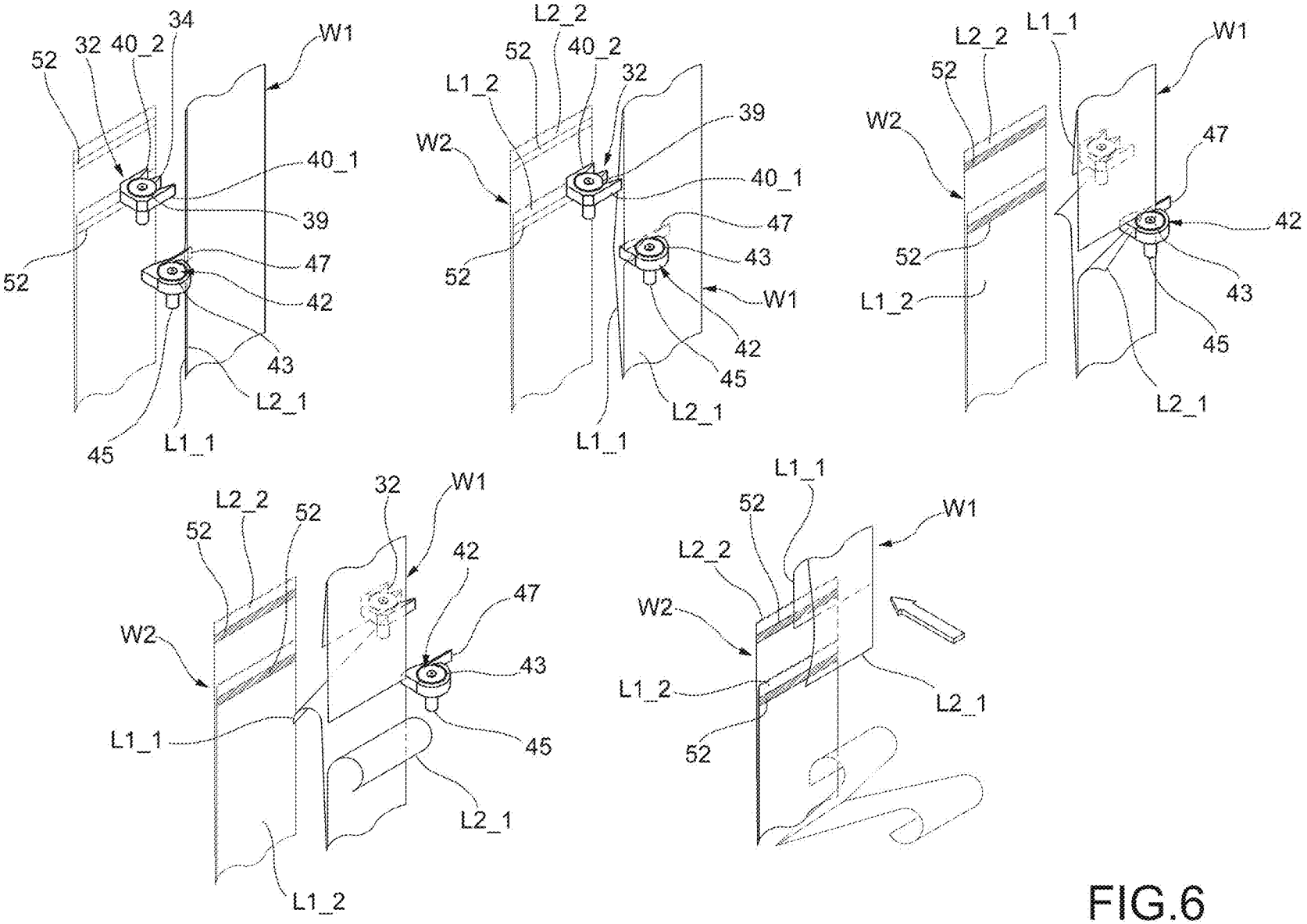
FIG. 6 shows in sequence the operations of cutting of the two layers of the tissue web in use and joining of the same with the two layers of a new tissue web in a feeding unit according to the present invention.

Referring also to FIGS. 5 and 6, the web in use (in the illustrated example, the web W1) moves through the cutting and joining device 28 along a substantially vertical direction, or a direction slightly inclined with respect to the vertical one. The cutting and joining device 28 comprises first of all a first cutting member 32, which is movable transversely (under control of suitable actuation means, which are of per-se-known type and are not shown in the drawings) with respect to the web W1 in use to cut one of the two layers of this web, namely the layer L1_1 facing the inside of the cutting and joining device 28 (hereinafter referred to simply as inner layer). The first cutting member 32 is, for example, carried by a vertical arm 36 slidably mounted on a guide profile 38 extending transversely to the web W1 (hence parallel to the axes x1 and x2 of the two reels R1 and R2).

According to an embodiment, the first cutting member 32 comprises a wedge-shaped central element 34 having a pair of surfaces 34*a* inclined to one another and converging toward a substantially vertical edge 34*b*. A circular blade 39 (FIG. 6), or similar cutting member, is rotatably mounted about a vertical axis of rotation on the central element 34. The rotation of the blade 39 about its axis is controlled by means of suitable actuation means, for example by means of an electric motor 41 (FIG. 5). The first cutting member 32 further comprises a pair of wedge-shaped side elements 40_1 and 40_2, arranged on opposite sides with respect to the central element 34. Each side element 40_1 and 40_2 cooperates with the surface 34*a* of the central element 34 facing thereto to guide the inner layer L1_1 of the web W1 in use towards the blade 39 with a given orientation with respect to the blade itself.

The first cutting member 32 is positioned with respect to the web portion passing through the cutting and joining device 28 so that it may enter with one of the two side elements 40_1 and 40_2 between the two layers L1_1 and L2_1 to cut the inner layer L1_1. In the illustrated embodiment, in which the web in use is the web W1 that is unrolled from the reel R1, the transverse movement of the first cutting member 32 causes the first side element 40_1 to pass between the two layers L1_1 and L2_1 of the web, thus causing the inner layer L1_1, which is placed between the first side element 40_1 and the central element 34, to be cut. Naturally, when on the contrary the web in use is the web W2 that is unrolled from the reel R2, the transverse movement of the first cutting member 32 causes the second side element 40_2 to pass between the two layers L1_2 and L2_2 of the web, thereby causing the inner layer L2_2, which is placed between the second side element 40_2 and the central element 34, to be cut.

The cutting and joining device 28 further comprises a pair of second cutting members 42 (only one of which is shown in the drawings, and specifically in FIG. 6), which are arranged on opposite sides of the first cutting member 32 with respect to a plane parallel to the web W1 in use and are both movable (under the control of suitable actuation means, which are of per-se-known type and are not shown in the drawings) transversely with respect to the web W1 in use to cut the other layer (i.e. the layer L2_1) of such web, i.e. to cut the layer facing the outside of the cutting and joining device 28 (hereinafter referred to as outer layer).

As can be seen by observing FIG. 6, the second cutting members 42 are also positioned vertically spaced with respect to the first cutting member 32 so as to cut the outer layer L2_1 of the web W1 in use along a cut line that is vertically spaced (therefore spaced along the longitudinal direction of the web W1) from the cut line along which the first cutting member 32 cuts the inner layer L1_1. More specifically, the first cutting member 32 is positioned above the second cutting members 42, so that the inner layer L1_1 of the web W1 in use is cut along a cut line positioned above the cut line along which the outer layer L2_1 is cut (or, more generally, positioned downstream of this cut line, with respect to the feeding direction of the web W1).

Still with reference to FIG. 6, according to an embodiment of the invention each second cutting member 42 comprises a circular blade 43, or similar cutting element, which is rotatably mounted about a vertical axis of rotation and is controllable in rotation about said axis by means of suitable actuation means, for example by means of an electric motor 45.

Each second cutting member 42 further comprises a separating element 47, made for example as a tab, having the function of separating the two layers L1_1 and L2_1 of the web W1 in use. The second cutting member 42 associated with the web W1 in use is normally kept in a position such that the separating element 47 slightly penetrates (e.g., one or two centimeters) inside the web W1 between the two layers L1_1 and L2_1 so as to keep the two layers detached from each other along the side edge of the web W1.

To summarize, therefore, both when the web in use is the web W1 that is being unrolled from the first reel R1 and when the web in use is the web W2 that is being unrolled from the second reel R2, the cutting and joining device 28 is arranged to cut the two layers of the web in use along cut lines spaced apart from each other in the longitudinal direction of the web, and specifically with the cut line of the inner layer positioned above the cut line of the outer layer. Cutting of the web W1 is preferably carried out by first cutting the outer layer L2_1 by means of the second cutting member 42 and then by cutting also the inner layer L1_1 by means of the first cutting member 32.

The cutting and joining device 28 is also arranged to join the two layers L1_1 and L2_1 of the web in use (in this case the web W1) once they have been cut by the first cutting member 32 and by the second cutting member 42 in the manner described above, each with a respective layer L1_2 and L2_2 of the new web (in this case the web W2).

To this end, according to an embodiment of the invention the cutting and joining device 28 further comprises a pair of plates 44_1 and 44_2 which are arranged on opposite sides with respect to the portion of web W1 in use that passes through the cutting and joining device 28 and are each carried by a respective support structure 46_1 and 46_2 mounted on the first upright 24 so as to be able to tilt about a horizontal axis of rotation parallel to the axes x1 and x2 between a rest position and a working position. The plate 44_1 and the respective support structure 46_1 are arranged on the same side as the reel R1, while the plate 44_2 and the respective support structure 46_2 are arranged on the same side as the reel R2. In the normal operating condition, the support structures 46_1 and 46_2 with the respective plates 44_1 and 44_2 are kept in the working position, where they are arranged vertically.

The support structure 46_2 with the respective plate 442 is shown in the drawings in the rest position, where it is arranged horizontally or slightly inclined to the horizontal. With the support structure 46_2 and the respective plate 44_2 in that position, the operator positions and locks the leading edges of the two layers L1_2 and L2_2 of the new web W2 on the plate 44_2 at a distance from each other equal to the distance between the cut lines along which the two layers L1_1 and L2_1 of the web W1 in use are cut by the first cutting member 32 and by the second cutting member 42. This operation is performed manually by the operator while the feeding unit 10 is feeding the machine with the web W1, so that when the web W1 is almost spent the new web W2 is ready to be joined to the web W1 to ensure continuous feeding of the machine. On the leading edges of the two layers L1_2 and L2_2 of the web W2, on the upwardly facing side, a layer of adhesive 52 (e.g. a double-sided adhesive tape) is applied to allow each layer of said web to be attached to the respective layer of the other web W1.

Once the spent web W1 has been cut in the manner described above, the two plates 44_1 and 44_2 are urged against each other so as to press the leading edges of the two layers L1_2 and L2_2 of the new web W2 (on which the adhesive layer 52 is applied) against the end edges of the two layers L1_1 and L2_1 of the web W1 and thus join each layer of the new web W2 to the respective layer of the web W1. To this end, each support structure 46_1, 46_2 comprises linear guides 48 for guiding the respective plate 44_1, 44_2 in the translational movement in a direction perpendicular to its plane and a linear actuator 50, made for example as a pneumatic cylinder, for controlling the movement of the respective plate 44_1, 44_2 in a direction perpendicular to its plane.

The cutting and joining operation is therefore carried out by the cutting and joining device 28 as follows, assuming that the web in use is the web W1 that is being unrolled from the reel R1.

Before the web W1 in use is spent, the new web W2 is prepared to be joined to the web W1. To this end, the operator places on the plate 44_2 of the support structure 46_2 (with the latter placed in the rest position) the two layers L1_2 and L2_2 of the new web W2 with the respective leading edges spaced from each other at a distance equal to the distance between the cut lines along which the first cutting member 32 and the second cutting member 42 are arranged to cut the two layers L1_1 and L2_1 of the web W1 in use, in particular with the inner layer L1_2 of the new web W2 shorter than the outer layer L2_2. The operator also applies a layer of adhesive 52 near the leading edges of both the layers L1_2 and L2_2 of the new web W2. When the web W1 in use is nearly spent, the accumulation unit 30 is controlled to accumulate a given amount of web downstream of the cutting and joining unit 28. Thereafter, the cutting and joining unit 28 is controlled to perform in succession the operations of cutting the web W1 in use and joining the new web W2 to the web W1. In this connection, the two layers L1_1 and L2_1 of the web W1 in use (which to this end is temporarily stopped) are cut by the first cutting member 32 and by the second cutting member 42 along respective cut lines spaced apart from one another and then the plate 44_1 of the support structure 46_1 is pushed against the plate 44_2 of the other support structure 46_2 so as to press the final end portion of each of the two layers L1_1 and L2_1 of the web W1 in use against the leading end portion of the respective layer L1_2 and L2_2 of the new web W2, thereby making these portions adhere to each other due to the adhesive layer 52 previously applied on the new web W2. At this point, the feeding unit 10 is ready to feed the machine with the new web W2. As can be seen from the above description, the transition from the condition where the machine is being fed with the web W1 to the condition where the machine is being fed with the new web W2 occurs with no interruptions in the feeding of the machine, which undoubtedly leads to an increase in the productivity of the machine.

Naturally, the principle of the invention remaining unchanged, the embodiments and constructional details may be greatly varied with respect to those described and illustrated here purely by way of a non-limiting example, without thereby departing from the scope of the invention as defined in the accompanying claims.

The invention claimed is:

1. A feeding unit (10) for feeding a tissue converting machine for converting a web (W1, W2) of two-layer tissue, the feeding unit (10) comprising:

support means (12) for rotatably supporting a first reel (R1) of two-layer tissue web and a second reel (R2) of two-layer tissue web for rotation about respective axes of rotation (x1, x2);

cutting means (32, 42) for cutting the two layers (L1_1, L2_1) of the tissue web (W1) of one (R1) of said first and second reels (R1, R2), namely the reel in use, said cutting means (32, 42) being configured to cut the two layers (L1_1, L2_1) of the tissue web (W1) along two cut lines spaced from each other in the longitudinal direction of the web (W1);

joining means (44_1, 44_2) for joining each of the two layers (L1_2, L2_2) of the tissue web (W2) of the other one (R2) of said first and second reels (R1, R2), namely the new reel, to a respective layer (L1_1, L2_1) of the tissue web (W1) of the reel (R1) in use; and tissue web accumulation means (30) for accumulating a given amount of tissue web (W1) downstream of the cutting means (32, 42) and of the joining means (44_1, 44_2) so as to ensure that the machine is fed with the tissue web (W1) while the portion of tissue web (W1) on which the cutting means (32, 42) and the joining means (44_1, 44_2) act is kept temporarily still to allow cutting of the two layers (L1_1, L2_1) of the tissue web (W1) in use and joining of these layers to the two layers (L1_2, L2_2) of the new tissue web (W2), wherein said cutting means (32, 42) comprise a first cutting blade (32) for cutting an inner layer (L1_1) of the tissue web (W1) in use and a pair of second cutting members (42) which are placed on opposite sides of the first cutting blade (32) with respect to a plane parallel to the web (W1) in use and are arranged to cut an outer layer (L2_1) of the tissue web (W1) in use, said second cutting members (42) being positioned at a distance from said first cutting blade (32) in the longitudinal direction of the tissue web (W1) in use, wherein said first cutting blade (32) is placed downstream of said second cutting members (42) with respect to the feeding direction of the tissue web (W1) in use, and wherein each of said second cutting members (42) comprises a separating element (47) adapted to be inserted between the two layers (L1_1, L2_1) of the tissue web (W1) in use to keep said layers (L1_1, L2_1) detached from each other along a side edge of the tissue web (W1) in use.

2. The feeding unit according to claim 1, wherein said first cutting blade (32) comprises a wedge-shaped central element (34), with a pair of surfaces (34*a*) inclined to each other so as to converge towards an edge (34*b*), a first cutting member (39) rotatably mounted on the central element (34) for rotation about an axis of rotation, first actuation means (41) for controlling the rotation of said first cutting member (39) about its axis of rotation, and a pair of wedge-shaped side elements (40_1, 40_2), which are placed on opposite sides with respect to the central element (34) and are arranged to cooperate each with the surface (34*a*) of the central element (34) facing thereto to guide the inner layer (L1_1) of the web (W1) in use towards said first cutting member (39).

3. The feeding unit according to claim 1 or claim 2, wherein each of said second cutting members (42) further comprises a second cutting blade (43) rotatably mounted about an axis of rotation, second actuation means (45) for controlling the rotation of said second cutting blade (43) about its axis of rotation.

4. The feeding unit according to any one of claims 1-3, wherein said joining means (44_1, 44_2) comprise a pair of plates (44_1, 44_2) arranged to be urged against each other to clamp the tissue web (W1) in use with the new tissue web (W2).

5. The feeding unit according to claim 2, further comprising a support frame (22) on which a plurality of rollers (20) are rotatably mounted, which rollers are oriented with the respective axes of rotation parallel to the axes of rotation (x1, x2) of the first and second reels (R1, R2) and are arranged to define the path of the tissue web (W1) in use towards an outlet (O) of the feeding unit, said path being oriented vertically, or mainly vertically, through a length thereof where said cutting means (32, 42) and said joining means (44_1, 44_2) are arranged to operate.

6. The feeding unit according to claim 1, further comprising a support frame (22) on which a plurality of rollers (20) are rotatably mounted, which rollers are oriented with the respective axes of rotation parallel to the axes of rotation (x1, x2) of the first and second reels (R1, R2) and are arranged to define the path of the tissue web (W1) in use towards an outlet (O) of the feeding unit, said path being oriented vertically, or mainly vertically, through a length thereof where said cutting means (32, 42) and said joining means (44_1, 44_2) are arranged to operate.

* * * * *